United States Patent [19]

Diamant

[11] 4,367,599

[45] Jan. 11, 1983

[54] SHOE SOLE STRUCTURE HAVING CONTROLLED SLIPPAGE

[76] Inventor: Frederick J. Diamant, 20 E. 35 St., New York, N.Y. 10016

[21] Appl. No.: 197,444

[22] Filed: Oct. 16, 1980

[51] Int. Cl.[3] ..... A43B 13/40; A43B 13/18; A43B 7/14

[52] U.S. Cl. ..... 36/44; 36/28; 36/88; 128/619

[58] Field of Search ..... 36/44, 43, 28, 91, 88; 128/619

[56] References Cited

U.S. PATENT DOCUMENTS

| | | | |
|---|---|---|---|
| 683,142 | 9/1901 | Reed | 36/44 |
| 1,093,608 | 4/1914 | Delaney | 36/43 X |
| 3,083,477 | 6/1961 | Diamant | 36/28 |
| 3,135,265 | 2/1964 | Hulzman | 128/619 |
| 3,344,537 | 10/1965 | Diamant | 36/91 |
| 3,412,487 | 10/1965 | Diamant | 36/44 |
| 3,629,961 | 12/1971 | Self | 36/44 X |

FOREIGN PATENT DOCUMENTS

| | | | |
|---|---|---|---|
| 998768 | 9/1951 | France | 36/43 |
| 2133082 | 11/1972 | France | 36/44 |

*Primary Examiner*—James Kee Chi

*Attorney, Agent, or Firm*—Seidel, Gonda, Goldhammer & Panitch

[57] ABSTRACT

A sock lining layer corresponding to the shape of a shoe is secured to one side of a foam layer of substantially the same size and shape. A backer layer is secured to the other side of the foam layer. The periphery of said layers are secured together. Slippage control between the sock lining and the foam layer is attained by stitching in the form of a closed loop wholly disposed at the location adapted to support a ball of a foot. The loop stitching has two extensions each extending from one end of the loop to the periphery of said layers at a location between the heel end of the layers and said one end of said loop.

13 Claims, 6 Drawing Figures

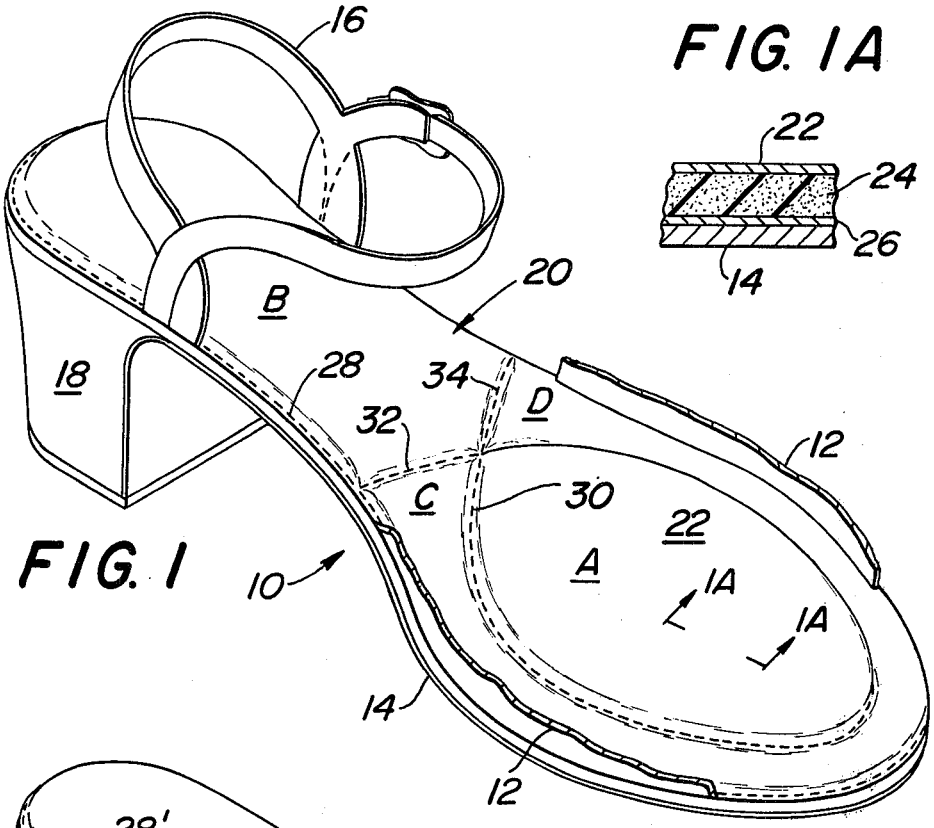
FIG. 1
FIG. 1A
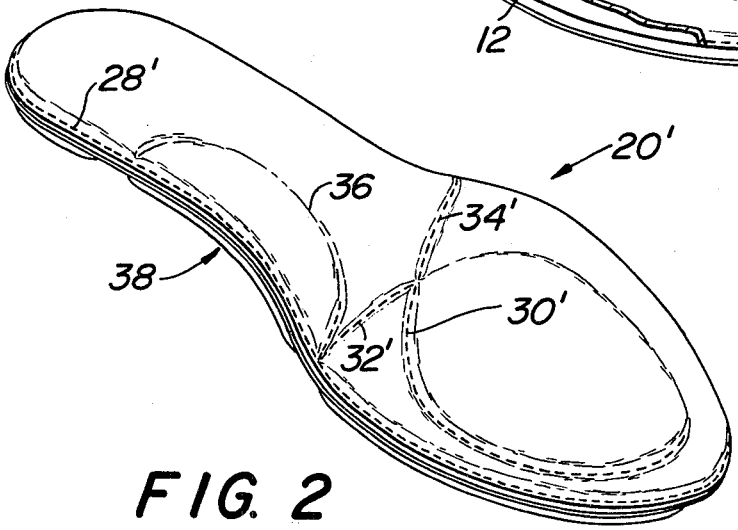
FIG. 2

FIG. 3
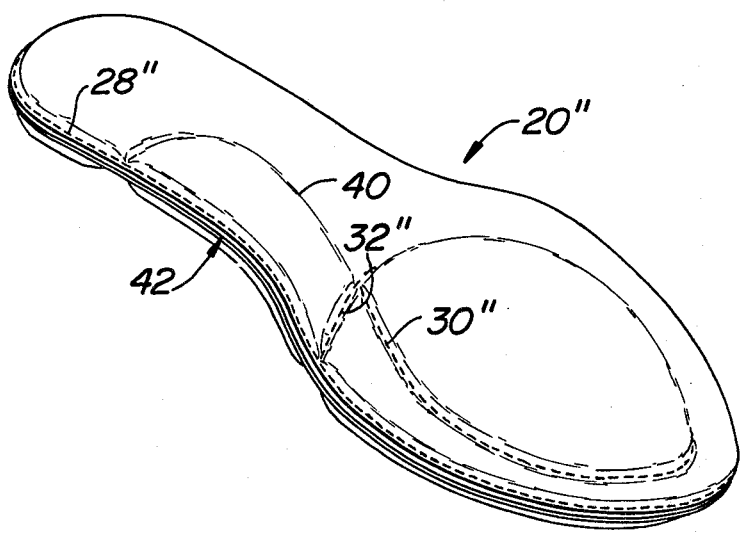
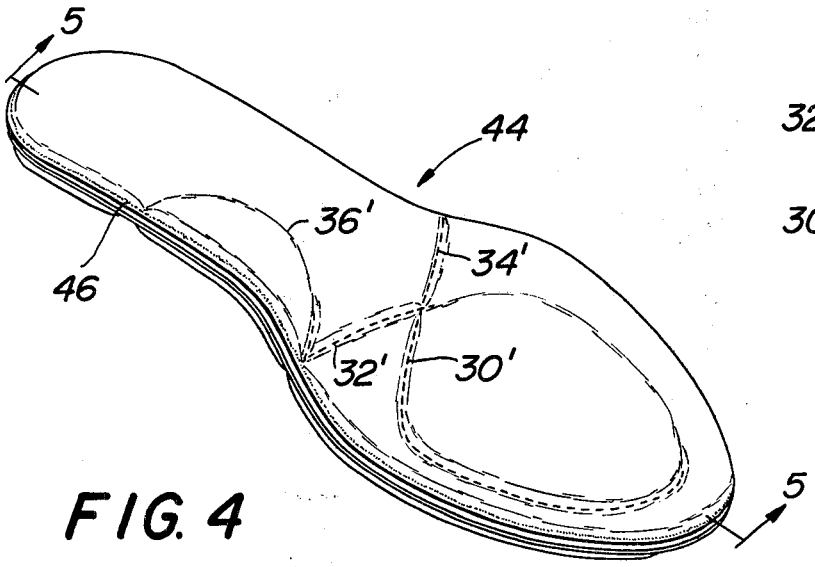
FIG. 4
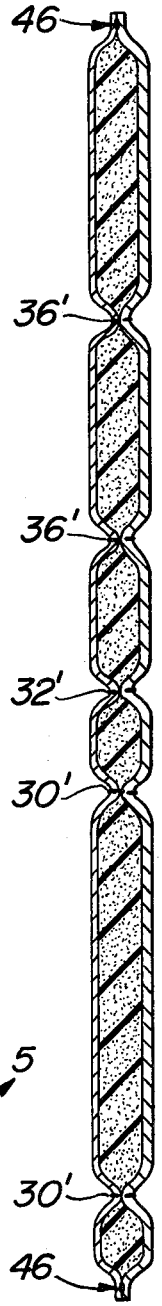
FIG. 5

SHOE SOLE STRUCTURE HAVING CONTROLLED SLIPPAGE

BACKGROUND

Shoe sole structures having control slippage are known to those skilled in the art. See U.S. Pat. Nos. 3,083,477; 3,412,487; and 3,344,537. The present invention is directed to an improvement on the sole structure disclosed in U.S. Pat. No. 3,083,477.

The present invention is directed to a solution of a problem which arises when the sole structure is constructed as disclosed in U.S. Pat. No. 3,083,477 but without the layers being fused or adhesively bonded together. For purposes of economy and to enable the insole to breathe it is desired to eliminate the bonding of the layers. During wear of the shoe sole structure disclosed in the last mentioned patent but without the layers being adhesively bonded together, the foam layer adjacent the arch of the foot tends to bunch up and move forwardly due to the pressure of the foot thereby causing discomfort to the wearer. The present invention is directed to a solution of this problem in a manner which is simple and inexpensive.

SUMMARY OF THE INVENTION

The present invention is directed to a shoe and an insole for a shoe. The insole includes a sock lining layer corresponding generally to the shape of a shoe which in turn corresponds generally to the shape of the bottom of a foot. A foam layer substantially the same size and shape as the sock layer is provided. A backer layer substantially the same size and shape as the sock lining is provided. A means joins the periphery of said layers. A means is employed to provide slippage control between the sock lining and the foam layer.

The slippage control means includes stitching to form a closed loop wholly disposed at the location adapted to support a ball of a foot. The loop stitching has two extensions each extending form one end of said loop to the peripheral joining means at a location between the heel end of the layers and said one end of said loop.

It is an object of the present invention to provide a shoe insole which inhibits a foam layer from bunching up in a forward direction toward the toe end of the insole from an area adjacent the arch portion of the insole in a manner which is simple, inexpensive, and reliable.

It is another object of the present invention to provide an insole with slippage control which is structurally interrelated in a manner so as to provide economy with respect to production operations, labor costs, while overcomming the problem of foam bunching forwardly toward the toe end of the insole from the arch area.

Other objects will appear hereinafter.

For the purpose of illustration the invention, there is shown in the drawing a form which is presently preferred; it being understood, however, that this invention is not limited to the precise arrangements and instrumentalities shown.

FIG. 1 is a perspective view of a typical shoe incorporated in the present invention.

FIG. 1A is a sectional view taken along the line 1A—1A in FIG. 1.

FIG. 2 is a perspective view of an insole in accordance with another embodiment of the present invention.

FIG. 3 is a perspective view of an insole in accordance with another embodiment of the present invention.

FIG. 4 is a perspective view of an insole in accordance with another embodiment of the present invention.

FIG. 5 is a sectional view taken along the line 5—5 in FIG. 4.

DETAILED DESCRIPTION

Referring to the drawing in detail, wherein like numerals indicate like elements, there is shown in FIG. 1 a perspective of a shoe 10 having an upper 12 joined to an outsole 14. The shape of the upper 12 may assume a wide variety of configurations and if desired may include straps 16. The particular shape of the shoe upper per se forms no part of the present invention. As illustrated, the show includes a heel 18 and an insole 20.

The insole 20 corresponds generally to the shape of the shoe which in turn corresponds generally to the shape of the sole of a foot. The insole 20 includes a sock lining layer 22, a foam layer 24 and a backer layer 26 all of the same general shape and size. The foam layer 24 is preferably slightly smaller in periphery as compared with the layers 22 and 26. A means is provided to join the periphery of layer 22 to the periphery of layer 26 without the use of adhesives. Such peripheral joining means is preferably thread stitching 28. Stitching 28 may be thread stitching or ultrasonic stitching. Alternatively, the joining means may be a heat seal attained simultaneously with the cutting of the layers.

Slippage control is attained by way of a closed loop by stitching 30 arranged generally in the form of a teardrop. Stitching 30 is preferably thread stitching but may be ultrasonic stitching. The closed loop is located wholly at the position or location adapted to support the ball of the foot and spaced inwardly from the peripheral stitching 28.

In order to prevent foam from the arch area bunching forwardly toward the toe, stitching 30 is provided with two extensions designated 32 and 34. The extensions 32 and 34 each extend from one end of the closed loop which is closest to the arch area of the insole 20 to the stitching 28 at a location between the heel end of the insole 20 and said one end of said loop. The stitching extensions 32 and 34 prevent the foam layer 24 from bunching forwardly from the arch area toward the toe. An insole 20 is stitched as described above will result in the areas designated A and B in FIG. 1 which are generally of the same thickness while the areas C and D will be slightly depressed thereby being thinner than areas A and B. As a result of this quilting effect, stitching 30, 32 and 34 does not irritate the foot of the wearer.

The loop stitching 30 and its extension 32, 34 are preferably applied at the same time as the application of the stitching 28. The preferred method is to start stitching 28 at a location where stitching 28 intersects stitching extension 32. The stitching 28 progresses around the entire periphery of the insole 20 and then is continued as defined by the stitching extension 32, is continued in the form of stitching 30, and then continues as stitching extension 32. Thus, all of the stitching 28, 30, 32 and 34 is done as one complete stitching step. This provides for economies of labor and production costs whereby all of such stitching takes less time than the time needed to provide the two separate peripheral and loop stitching as disclosed in said U.S. Pat. No. 3,083,477. In addition to saving time, the added stitching extensions 32, 34 solve a problem whereby there is little or no tendency for the foam layer 24 to bunch forwardly from the arch area. At the same time, there is no stitching in the heel area which would interfere with comfort.

In FIG. 2, there is illustrated another embodiment of the insole designated 20'. Insole 20' is identical with insole 20 except as will be made clear hereinafter. Hence, corresponding prime numerals are provided.

On insole 20', the stitching 32' is extended in the form of a crescent shape as shown at 36 in the arch area of the insole and thereby intersects the stitching 28' in the area between the heel and the arch area. In this embodiment, the stitching 28' begins and ends adjacent one end of the stitching 34' and then continues as stitching 34', then to form the loop stitching 30', then the stitching extension 32', and then the crescent shape stitching 36 so as to define a crescent shaped area adjacent the arch area 38. Since the stitching 36 is in the arch area 38, there is little discomfort. The insole 20' is otherwise identical with insole 20 and may be substituted therefor in the shoe 10.

In FIG. 3 there is illustrated another embodiment of the insole designated generally as 20''. Insole 20'' is identical with insole 20 except as will be made clear hereinafter. Hence, corresponding double prime numerals are provided in FIG. 3. As shown in FIG. 3, instead of the extension stitching 34, there is provided extension stitching 40 which is a continuation of the loop stitching 30''. The extension stitching 40 extends to the peripheral stitching 28'' on the same side thereof as the stitching extension 32'' to thereby enclose an area along the arch support area designated 42. The stitching of the various layers of insole 20'' is accomplished in a continuous manner as described above in connection with insole 20. Insole 20'' is otherwise identical with insole 20 and may be substituted therefor in the shoe 10.

In FIG. 4 there is illustrated another insole in accordance with the present invention designated generally as 44. The insole 44 is identical with the insole 20' except as will be made clear hereinafter. Hence, corresponding elements are identified with corresponding numerals. The extension stitching 32' on insole 44 does not extend to the peripheral joining means but stops short thereof and then extends along the crescent shaped loop 36' to the peripheral joining means adjacent the forward end of the heel. The peripheral joining means instead of being stitching as described above is in the form of a heat seal 46 which is applied simultaneously with the cutting of the layers. Insole 44 is otherwise identical with insole 20' and may be substituted for the insole 20 in shoe 10.

The sock lining in each of the embodiments may be made of leather or plastic material. The backer layer of each insole may be made of canvas, plastic, etc. The foam layer of each embodiment is preferably foam polymeric plastic material such as foam polyurethane $\frac{3}{8}$ inches thick when uncompressed. In each embodiment, the layers of the insole are only joined together by the stitching described above with no adhesive between any of the layers. Thus, the requirement of adhesively bonding the layers of the insole is eliminated by the present invention. Since the layers of the insole are not adhesively bonded to one another, the various stitching described above will act as a ventilator for the space between the sock lining layer and the backer layer whereby air may escape as the foam layer is compressed due to walking by the wearer. In each embodiment, the stitching may computer controlled or may be any other conventional stitching.

The present invention may be embodied in other specific forms without departing from the spirit or essential attributes thereof and, accordingly, reference should be made to the appended claims, rather than to the foregoing specification, as indicating the scope of the invention.

I claim:

1. An insole for use in a shoe comprising a sock lining layer corresponding generally to the shape of a shoe, a foam layer substantially the same size and shape as the sock lining layer, a backer layer substantially the same size and shape as the sock lining layer, means joining the periphery of said layers, means providing a slippage control between said sock lining layer and said foam layer, said slippage control means including stitching in the form of a closed loop wholly disposed at the location adapted to support a ball of a foot, said loop stitching having two extensions each extending from one end of said loop to said peripheral joining means at a location between the heel end of the layers and said one end of said loop, said loop stitching and said extensions constituting one continuous and uninterrupted stitching.

2. An insole in accordance with claim 1 wherein said peripheral joining means is stitching, one of said extensions also being an extension of said peripheral stitching.

3. An insole in accordance with claim 1 wherein one of said extensions includes at least a portion which is arcuate and disposed in the arch support area of the insole.

4. An insole in accordance with claim 1 wherein each of said extension stitching is of the same length.

5. An insole in accordance with claim 1 wherein one of said extension stitchings is longer then the other and each intersects the peripheral joining means adjacent the arch support area on one side edge of the insole.

6. An insole in accordance with claim 1 wherein said extension stitchings are of different lengths and intersect the peripheral joining means on opposite side edges of the insole.

7. An insole in accordance with claim 1 wherein said stitching extensions are of different lengths and intersect the peripheral joining means on opposite side edges of the insole, the longer of said extension stitching intersecting the peripheral joining means only in the area adjacent the intersection of the heel area and the arch support area.

8. An insole in accordance with claim 1 wherein said layers are secured together only by said stitching and said peripheral joining means.

9. A shoe having an insole in accordance with claim 1.

10. An insole in accordance with claim 1 wherein said joining means is heat sealing.

11. An insole in accordance with claim 1 wherein said joining means is thread stitching.

12. An insole in accordance with claim 1 wherein said joining means is ultrasonic stitching.

13. An insole for use in a shoe comprising a sock lining layer corresponding generally to the shape of a shoe, a foam polymeric plastic layer of uniform thickness and substantially the same size and shape as the sock lining layer, a backer layer substantially the same size and shape as the sock lining layer, means adjacent the periphery of said layers for retaining said layers in assembled relation with the foam layer being the middle layer, means providing a slippage control between said sock lining layer and said foam layer, said slippage control means including stitching in the form of a closed elongated loop wholly disposed at the location adapted to support a ball of a foot, said loop stitching having two extensions each extending from one end of said loop toward the periphery of said layers at a location between the heel end of the layers and said one end of said loop, said loop stitching and said extensions constituting one continuous and uninterrupted stitching.

* * * * *